United States Patent [19]

Chilton et al.

[11] Patent Number: 4,932,163

[45] Date of Patent: Jun. 12, 1990

[54] DUST CONTROL SYSTEM FOR AN ABRASIVE GRINDER

[76] Inventors: Douglas L. Chilton, 6729 Bridge St.; Cher I. Chilton, 7300 Brentwood Stair Rd., both of Fort Worth, Tex. 76112

[21] Appl. No.: 399,921

[22] Filed: Aug. 29, 1989

[51] Int. Cl.[5] ..... B24B 23/02

[52] U.S. Cl. ..... 51/170 T; 51/358; 51/273

[58] Field of Search ..... 51/170 T, 170 R, 170 MT, 51/358, 380, 391, 273

[56] References Cited

U.S. PATENT DOCUMENTS

| | | |
|---|---|---|
| Re. 26,552 | 3/1969 | Block et al. . |
| 3,673,744 | 7/1972 | Oimoen . |
| 3,824,745 | 7/1974 | Hutchins . |
| 3,862,521 | 1/1975 | Isaksson . |
| 3,935,678 | 2/1976 | Marton . |
| 4,135,334 | 1/1979 | Rudiger . |
| 4,145,848 | 3/1979 | Hutchins . |
| 4,531,329 | 7/1985 | Huber . |
| 4,616,449 | 10/1986 | Marton . |

OTHER PUBLICATIONS

Merit Abrasives Catalog 20.
Dynabrade Catalog, pp. 38 and 52.
Dynabrade Brochure LW01-88.
Dustcontrol Brochure.

*Primary Examiner*—Roscoe V. Parker
*Attorney, Agent, or Firm*—James E. Bradley

[57] ABSTRACT

A dust control system is shown for an abrasive grinder. The grinder backing plate is provided with a socket which provides rotating engagement with the mating hub provided on the abrasive disk. As the disk is rotated between a release position and an engagement position, air passage holes provided in abrasive disk are aligned with mating holes provided in the disk backing plate. The device also includes a shroud connected to a vacuum source, the shroud being spaced from the grinder backing plate by a predetermined gap to allow the intake of dust from the work surface.

7 Claims, 1 Drawing Sheet

DUST CONTROL SYSTEM FOR AN ABRASIVE GRINDER

BACKGROUND OF THE INVENTION

1. Field of the Invention

The present invention relates to portable abrasive grinders in which particles abraded from a work surface are withdrawn by suction through a tool shroud to a collection location.

2. Description of the Prior Art

Abrasive grinders of the type under consideration are of a known general type comprising a portable body which is adapted to be held by a user and which contains a motor acting to drive a backing plate which in turn carries an abrasive disk for abrading a work surface. In the "vacuum" type grinder, a shroud in the vicinity of the backing plate and abrasive disk defines a chamber through which air and entrained particles flow to an outlet leading to an accumulation point. The abrasive disk and backing plate are provided with holes which, when aligned, form an air passage to allow the flow of air and entrained particles which were drawn by suction to the shroud.

For economy in employing such abrasive disks in fabrication operations, it is essential that the labor cost be minimized by making the abrasive disk easily replaceable on the backing plate in a rapid and convenient manner. Many of the commercially available disks are provided with an adhesive backing which is peeled off during installation. The disk holes and backing plate holes are manually aligned. This process is time consuming and can result in misalignment of the disk and backing plate holes. Although quick attach couplings have been provided for abrasive disks in such patents as U.S. Pat. No. 26,552, Re. to Block, issued Mar. 25, 1969, such prior devices have not provided a method for aligning the disk holes with the corresponding holes provided in the backing plate of a vacuum type abrasive grinder.

Another problem in the prior art devices is the tendency for the rapid rotary motion of the grinder backing plate to cause abraded particles contacting the unit to move radially outward under the influence of centrifugal force, with the tendency for some particles to escape the periphery of the backing plate and shroud. One attempt to overcome this problem has been the provision of a resilient lip seal carried by the shroud for contacting an upper surface of the backing plate during use. See, for example, U.S. Pat. No. 4,531,329 to Huber, issued Jul. 30, 1985. However, contact between the seal and backing plate can retard or even arrest movement of the sanding member or movement of the machine over the work area. I have surprisingly discovered that the provision of a controlled gap between the backing plate and shroud produces improved results with high speed grinders operating in the 12,000–24,000 r.p.m. range.

The present invention has as its object an improved dust control system which features the synergistic effect of a controlled gap between the shroud and upper surface of the backing plate along with flow passages formed by the aligned holes provided in the backing plate and abrasive disk.

The present invention also has as its object an improved quick attach method for attaching an abrasive disk to the backing plate which automatically aligns the corresponding holes in the disk and backing plate which are used as flow passages for the air and entrained particles which flow from the work surface to the shroud.

Additional objects, features and advantages will be apparent in the written description which follows.

SUMMARY OF THE INVENTION

The dust control system of the invention is adapted for use with an abrasive grinder of the type having a motor driven output shaft. A backinq plate is coupled to the grinder output shaft. The backing plate has upper and lower surfaces and a plurality of circumferentially spaced holes which communicate the upper and lower surfaces. The backing plate is also provided with a socket on the lower surface thereof. A shroud encircles the backing plate and is connected to a vacuum source for removing dust particles from a work surface. The lower surface of the backing plate is adapted to engage an abrasive disk of the type having an abrasive bottom surface, a top surface and a plurality of circumferentially spaced holes which communicate the top and bottom surfaces.

The abrasive disk is provided with a hub structure on the top surface. Cooperating engagement means on the hub and socket, respectively, allow the hub to fit loosely in the socket at a first rotary position of the hub structure relative to the socket and to bind against the socket at a second relative rotary position. The first and second rotary positions are angularly offset by a predetermined degree of rotation. The degree of rotation is sufficient to automatically align the holes on the backing plate with the holes on the abrasive disk when the hub is moved from the first to the second relative rotary position. The shroud is also spaced-apart from the top surface of the backing plate by a predetermined gap to allow for the intake of dust particles between the disk top surface and the shroud.

DETAILED DESCRIPTION OF THE INVENTION

Figure 1:
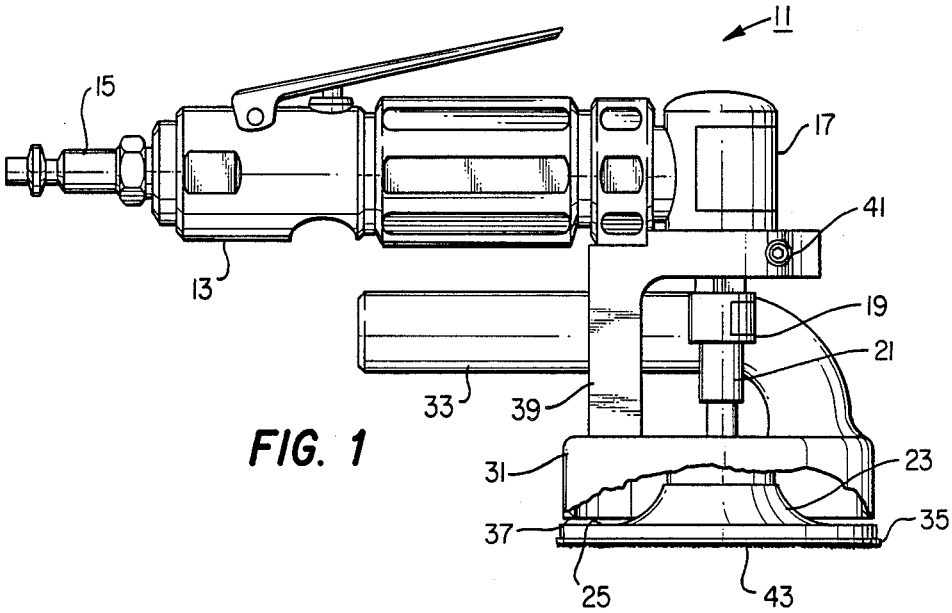
FIG. 1 is a perspective view of a portable abrasive grinder of the invention showing the shroud surrounding the backing plate with portions broken away for ease of illustration.

FIG. 1 shows a portable abrasive grinder of the invention designated generally as 11. The grinder 11 includes a valve 13 which is coupled to a remote air source through a conduit 15 in order to power a motor 17 having a vertically oriented output shaft 19. The grinder can be, for instance, a DOTCO Sander Model No. 10L1280-36, right angle, air powered, rear exhaust, 12,000 rpm, 3 inch sanding disk capacity, available from DC Tool, Fort Worth, Tex. Grinders of the type under consideration typically operate at speeds on the order of 12,000–20,000 rpm for driving a 3 inch disk.

The output shaft 19 of the motor 17 is joined by a coupling 21 to a backing plate 23 for driving the backing plate 23 in rotary fashion about the vertical axis defined by the output shaft 19.

Figure 2:
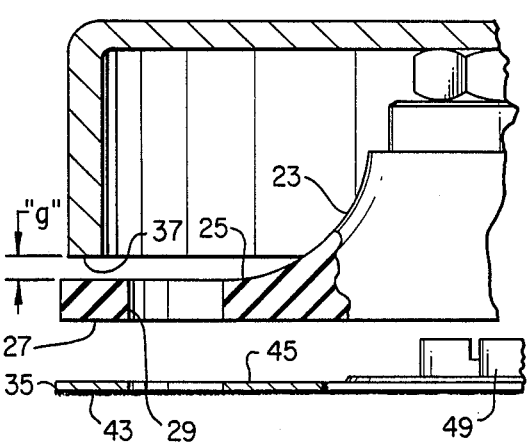
FIG. 2 is a partial, sectional view of the shroud, backing plate and abrasive disk used with the abrasive grinder of FIG. 1.
Figure 3:
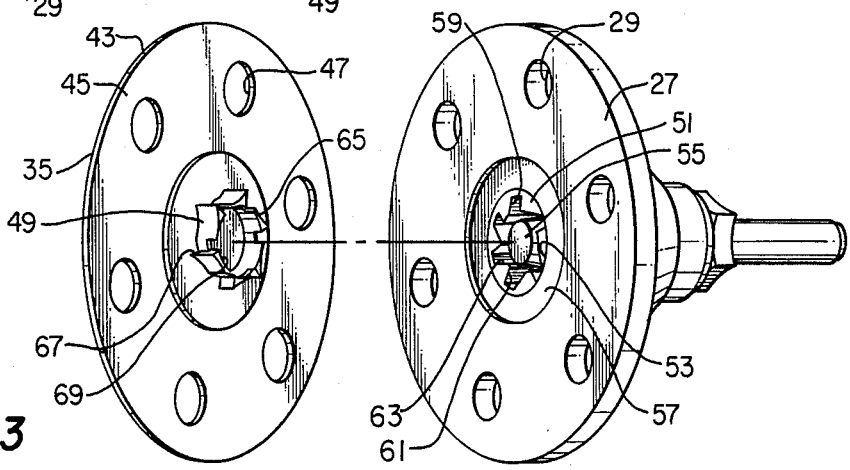
FIG. 3 is an isolated view of the lower surface of the backing plate showing the abrasive disk in exploded fashion.

As shown in FIG. 2, the backing plate 23 has an upper surface 25, a lower surface 27 and a plurality of holes 29 which communicate the upper and lower surfaces 25, 27. The lower surface 27 of the backing plate has a circular periphery and, as shown in FIG. 3, six holes 29 are circumferentially spaced about the periphery at regular intervals. For a 3" diameter disk, the backing plate holes 29 are on the order of 7/16" in diameter. The backing plate may be formed of any appropriate material which is sufficiently resilient to press an abrasive disk against a work surface and return the abrasive disk to an approximately planar condition when out of contact with the work surface. For instance, the backing plate 23 can be formed of an appropriate fabric-reinforced resinous plastic material, such as a suitable phenolic. Alternatively, the backing plate could be made of a hard rubber.

A shroud 31 encircles the backing plate 23 and is connected to a suitable commercially available vacuum source (not shown) by means of conduit 33 for removing dust particles from a work surface. By "dust particles" is meant spent abrasive particles and other particulate matter created by the grinding operation which are entrained in the air flowing through shroud and through the conduit 33 to the dust collection point.

The shroud 31 includes a cylindrical lower edge 37 of the approximate outer diameter of the backing plate upper surface 25. As shown in FIG. 2, the lower edge 37 is spaced-apart from the upper surface 25 by a predetermined gap "g" to allow for the intake of dust particles between the work surface and the shroud about the periphery of the backing plate. Preferably the gap is in the range from about ⅛ to 5/16 inches, most preferably about 3/16 inch. The shroud 31 can be retained in position by providing a support arm 39 with an appropriate opening to receive the output shaft 19 of the motor, the arm being retained in position by a set screw 41. An abrasive disk 35 secures to the backing plate 23. Also, the lower edge 37 of the shroud 31 has an outer diameter that is slightly less than the backing plate 23. In addition, the abrasive disk 35 is slightly greater in outer diameter than the backing plate 23. Preferably, for a 3" disk 35, the backing plate 23 is 2.85" and the shroud edge 37 is 2.75".

The abrasive disk 35 is circular in shape and has an abrasive bottom surface 43, a top surface 45 and a plurality of circumferentially spaced holes 47 which are adapted to be aligned with the backing plate holes 29. For a 3" diameter disk, the holes 47 are on the order of 5/16" diameter. Preferably, there are six circumferentially spaced holes. The disk upper surface 45 is also provided with a hub structure 49.

The disk hub 49 and backing plate socket 51 include cooperating engagement means, respectively, for allowing the hub 49 to fit loosely in the socket 51 at a first rotary position of the hub structure relative to the socket and to bind against the socket at a second relative rotary position. The first and second rotary positions are angularly offset by a predetermined degree of rotation, the degree of rotation being sufficient to align the holes 29 on the backing plate with the holes 47 on the abrasive disk when the hub is moved from the first to the second relative rotary position. Preferably, the degree of rotation for a 3 inch diameter disk is in the range from about 10 to 20 degrees, most preferably about 15 to 16 degrees.

The cooperating engagement means on the hub 49 and socket 51 can be any means for conveniently allowing the hub to fit loosely in the socket at a first rotary position and to bind against the socket at a second relatively rotary position, the first and second rotary positions being angularly offset by the required degree of rotation. For instance, the cooperating engagement means can be those shown in U.S. Pat. No. 26,552, Re. to Block, issued Mar. 25, 1969, the disclosure of which is incorporated herein by reference. Thus, the socket 51 can include a circumferential cylindrical wall 53 and an axial boss 55. Within the socket is a liner of cylindrical configuration having six equally spaced, radially inward triangular projections or teeth 57 which form six equally spaced peripheral recesses 59. Each of the radially inward projections 57 has a substantially radial stop face 61 and an opposite inclined cam face or shoulder 63.

The hub structure 49 is adapted for snap-on engagement with the socket structure 51 and has six slots which divide the hub structure into six flexible fingers 65. Each of the fingers 65 has a substantially radial stop face 67 and an oppositely directed incline shoulder or cam face 69. At the first rotary position or release position, the stop faces 67 of the fingers 65 abut the stop faces 61 of the corresponding projections 57. At this orientation of the abrasive disk relative to the socket structure, the hub structure 49 of the abrasive disk may freely pass into and out of the socket of the socket structure.

Rotating the disk 35 relative to the backing plate 23 causes the cam shoulders 63 of the six radially inward projections 57 to press against the cooperating cam faces 69 of the flexible fingers 65, thereby reaching the second rotary limit position and interlocking the hub and socket. The abrasive disk 35 can be removed from the socket structure by simply pulling outward on the abrasive disk.

Although the invention has been described with respect to the snap-on hub and socket arrangement of U.S. Pat. No. 26,552, Re. other arrangements could be used as well, as long as the particular engagement means allow the hub to fit loosely in a first rotary position and to be turned through a predetermined degree of rotation to a second binding position, the degree of rotation being calculated to allow the alignment of the disk holes 47 with the backing plate holes 29.

An invention has been provided with several advantages. By utilizing cooperating engagement means which are actuated by a predetermined degree of rotation, the air passage holes on the abrasive disk and the backing plate can be quickly and accurately aligned. The system is superior to prior art adhesive applications which required manual alignment of the air passage holes. The combination of air passage holes in the disk and backing plate, and a controlled gap between the shroud and backing plate, provides a more efficient dust control system than was achieved with the prior art systems.

Because the coupling of the abrasive disk to the backing plate is mechanical, much higher speeds over prior art adhesive types are possible. The higher rotation speed allows the work to be accomplished faster. The mechanical coupling avoids the risk of the disk separating from the backing plate at high speeds.

While the invention has been shown in only one of its forms, it is not thus limited but is susceptible to various changes and modifications without departing from the spirit thereof.

I claim:

1. A dust control system for an abrasive grinder of the type having a motor driven output shaft, comprising:

a backing plate coupled to the grinder output shaft, the backing plate having upper and lower surfaces and a plurality of circumferentially spaced holes which communicate the upper and lower surfaces, the backing plate also being provided with a socket on the lower surface thereof;

a shroud encircling the backing plate, the shroud being connected to a vacuum source for removing dust particles from a work surface;

an abrasive disk having an abrasive bottom surface, a top surface and a plurality of circumferentially spaced holes which communicate the bottom and top surfaces, the abrasive disk also being provided with a hub structure on the top surface thereof;

cooperating engagement means on the hub and socket, respectfully, for allowing the hub to fit loosely in the socket at a first rotary position of the hub structure relative to the socket and to bind against the socket at a second relative rotary position, the first and second rotary positions being angularly offset by a predetermined degree of rotation, the degree of rotation being sufficient to align the holes on the backing plate with the holes on the abrasive disk when the hub is moved from the first to the second relative rotary position.

2. The dust control system of claim 1, wherein the degree of rotation is in the range from 10 to 20 degrees.

3. The dust control system of claim 2, wherein the cooperating engagement means on the hub and socket comprises cooperating shoulders which releasably engage each other in response to rotation of the hub structure from its first rotary position to its second rotary position.

4. The dust control system of claim 2, wherein the cooperating engagement means comprises a boss in the socket, the hub being dimensioned to fit into the socket around the boss.

5. A dust control system for an abrasive grinder of the type having a motor driven output shaft, comprising:

a backing plate coupled to the grinder output shaft, the backing plate having upper and lower surfaces and a plurality of circumferentially spaced holes which communicate the upper and lower surfaces, the backing plate also being provided with an interior recess which defines a socket on the lower surface thereof;

a shroud encircling the backing plate, the shroud being connected to a vacuum source for removing dust particles from a work surface;

an abrasive disk having an abrasive bottom surface, a top surface and a plurality of circumferentially spaced holes which communicate the bottom and top surfaces, the abrasive disk also being provided with a hub structure on the top surface thereof dimensioned to fit loosely in the socket of the backing plate at a first rotary position of the hub structure relative to the socket and to bind against the interior recess of the socket at a second relative rotary position for rotation of the abrasive disk by the backing plate, the first and second rotary positions being angularly offset by a predetermined degree of rotation, the degree of rotation being sufficient to align the holes on the backing plate with the holes on the abrasive disk when the hub is moved from the first to the second relative rotary position to allow the intake of dust particles from the work surface to the shroud; and wherein the shroud is spaced apart from the top surface of the backing plate by a predetermined gap to allow for the intake of dust particles between the work surface and the shroud about the periphery of the backing plate.

6. The dust control system of claim 5, wherein the gap is in the range from about $\frac{1}{8}$ to 5/16 inches.

7. An abrasive disk for use with an abrasive grinder of the type having a motor driven output shaft and a backing plate coupled to the output shaft, the backing plate having upper and lower surfaces and a plurality of circumferentially spaced holes which communicate the upper and lower surfaces, the disk comprising:

a body having an abrasive bottom surface, a top surface and a plurality of circumferentially spaced holes which communicate the bottom and top surfaces, the body also being provided with a hub structure on the top surface thereof which is adapted to matingly engage a socket provided on the grinder backing plate; and wherein the hub is provided with engagement means adapted to engage cooperating engagement means on the socket, for allowing the hub to fit loosely in the socket at a first rotary position of the hub relative to the socket and to bind against the socket at a second relative rotary position, the first and second rotary positions being angularly offset by a predetermined degree of rotation, the degree of rotation being sufficient to align the holes on the backing plate with the holes on the abrasive disk when the hub is moved from the first to the second relative rotary position.

* * * * *